US011466594B2

(12) United States Patent
Kozlov et al.

(10) Patent No.: US 11,466,594 B2
(45) Date of Patent: Oct. 11, 2022

(54) COMBINED COOLING, HEATING AND POWER SYSTEM

(71) Applicant: GAS TECHNOLOGY INSTITUTE, Des Plaines, IL (US)

(72) Inventors: Aleksandr Kozlov, Buffalo Grove, IL (US); Yaroslav Chudnovsky, Skokie, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 0 days.

(21) Appl. No.: 16/297,928

(22) Filed: Mar. 11, 2019

(65) Prior Publication Data

US 2019/0277164 A1 Sep. 12, 2019

Related U.S. Application Data

(60) Provisional application No. 62/641,295, filed on Mar. 10, 2018.

(51) Int. Cl.
*F01K 11/00* (2006.01)
*F01K 19/00* (2006.01)
(Continued)

(52) U.S. Cl.
CPC ..... *F01K 19/00* (2013.01); *F01K 7/16* (2013.01); *F01K 11/02* (2013.01); *F01K 21/005* (2013.01); *F22D 11/06* (2013.01)

(58) Field of Classification Search
CPC ..... F01K 19/00; F01K 7/16; F01K 21/005; F01K 11/02; F22D 11/06
See application file for complete search history.

(56) References Cited

U.S. PATENT DOCUMENTS 4,106,294 A * 8/1978 Czaja ..... F01K 21/04 60/649
5,666,800 A * 9/1997 Sorensen ..... F25J 3/04545 60/781

(Continued)

OTHER PUBLICATIONS

"Catalog of CHP Technologies", U.S. Environmental Protection Agency Combined Heat and Power Partnership, EPA Combined Heat and Power Partnership, Sep. 2017, 150 pages.

*Primary Examiner* — Matthew T Largi
(74) *Attorney, Agent, or Firm* — Pauley Erickson & Swanson

(57) ABSTRACT

A combined cooling, heating, and power system, including a working fluid cycling between a compressor and a turbine in combination with a power generator. A humidifying regenerator is disposed between the compressor and the turbine, and in combination with the working fluid upstream and again downstream of the turbine to humidify and then dehumidify the working fluid. A working fluid heat exchanger is in combination with the working fluid between the turbine and the humidifying regenerator for further heat the working fluid. The heat exchanger is in combination with a heat source that heats both the working fluid and provides a separate heating medium. A cooling device is in combination with the working fluid between the humidifying regenerator and the compressor, wherein the cooling device cools the working fluid before entering the compressor and provides a separate cooling medium.

20 Claims, 6 Drawing Sheets

(51) Int. Cl.

| | |
|---|---|
| ***F01K 7/16*** | (2006.01) |
| ***F22D 11/06*** | (2006.01) |
| ***F01K 21/00*** | (2006.01) |
| ***F01K 11/02*** | (2006.01) |

(56) References Cited

U.S. PATENT DOCUMENTS

| | | | | |
|---|---|---|---|---|
| 6,397,600 | B1 * | 6/2002 | Romanelli | F01K 25/08 60/651 |
| 7,472,550 | B2 | 1/2009 | Lear, Jr. et al. | |
| 8,006,499 | B2 | 8/2011 | Koganezawa et al. | |
| 9,624,913 | B2 | 4/2017 | Friesth | |
| 2010/0126171 | A1 * | 5/2010 | Smith | F01K 21/04 60/641.8 |
| 2012/0255302 | A1 | 10/2012 | Hugelman et al. | |
| 2016/0069329 | A1 * | 3/2016 | Brodetsky | F02C 3/04 60/641.14 |
| 2016/0138431 | A1 | 5/2016 | Lear, Jr. | |
| 2016/0348538 | A1 * | 12/2016 | Sato | F02C 7/141 |
| 2016/0348539 | A1 * | 12/2016 | Peter | F02C 1/05 |
| 2019/0234341 | A1 * | 8/2019 | Maisotsenko | F02G 1/02 |

* cited by examiner

| Turbine pressure | Turbine inlet working fluid | | | Compressor inlet working fluid | | | Power cycle |
|---|---|---|---|---|---|---|---|
| | Flow rate, kg/s | Temp., C | Pressure, bara | Flow rate, kg/s | Temp., C | Pressure, bara | efficiency, % |
| Above-atmospheric | 4.2 | 450 | 30.0 | 0.382 | 1.0 | 10.0 | 61.0 |
| Near-atmospheric | 18.47 | 159 | 1.38 | 1.680 | 1.0 | 0.9 | 64.0 |
| Sub-atmospheric | 17.78 | 147 | 1.08 | 0.847 | 1.0 | 0.7 | 72.0 |

COMBINED COOLING, HEATING AND POWER SYSTEM

CROSS REFERENCE TO RELATED APPLICATION

This application claims the benefit of U.S. Provisional Application, Ser. No. 62/641,295, filed on 10 Mar. 2018. The provisional application is hereby incorporated by reference herein in its entirety and is made a part hereof, including but not limited to those portions which specifically appear hereinafter.

STATEMENT REGARDING FEDERALLY SPONSORED RESEARCH OR DEVELOPMENT

This invention was made with government support under grant DE-FE0031614 awarded by the Department of Energy. The government has certain rights in the invention.

BACKGROUND OF THE INVENTION

Field of the Invention

This invention relates generally to a combined cooling, heating, and power (CCHP) system for electric power generation, space heating and space cooling from a fuel source.

Description of Related Art

Existing CCHP systems are usually based on state-of-the-art Combined Heat and Power (CHP) systems by adding a device for space cooling, e.g., absorption chiller or compression-type refrigeration machine. While existing thermally-driven CHP systems sized to fill 100% of a facility thermal demand (low power to heat ratio (P/H), typically below 0.75) are currently cost effective in some markets and applications, there still remains a vast unserved market with smaller thermal demand relative to electrical (P/H>1.0) or with thermal and cooling demand in the industrial, commercial/institutional, and/or residential sectors.

SUMMARY OF THE INVENTION

The invention includes or provides a Combined Cooling, Heating, and Power (CCHP) system for electric power generation, space heating and space cooling, such as from a single fuel or solar source, which can be utilized in a variety of industrial facilities, commercial, institutional, and multi-family buildings. Embodiments of the invention provide a CCHP system with a closed loop working fluid in a turbo-compressor cycle, operating at above-, near-, or sub-atmospheric conditions. The working fluid cycles between a compressor and a turbine in combination with a power generator. A humidifying regenerator is disposed between the compressor and the turbine, and in combination with the working fluid upstream and again downstream of the turbine. A working fluid heat exchanger is in combination with the working fluid between the turbine inlet and the humidifying regenerator, and a cooling device is in combination with the working fluid between the humidifying regenerator and the compressor inlet.

The humidifying regenerator is configured to humidify the working fluid after the compressor and to dehumidify the working fluid after the turbine. The humidifying regenerator increases a mass of the working fluid before the turbine and reduces the mass of the working fluid after the turbine and before entry into the compressor. Condensate from the humidifying regenerator and the cooling device can be used by the humidifying regenerator to humidify the working fluid.

The dehumidified working fluid is introduced to the cooling device. The cooling device cools the working fluid to provide a cooled, dehumidified working fluid that is introduced to the compressor. The cooling device also desirably cools a return medium flow that is independent of the working fluid. The cooling device can be powered by any system power generator, or an external electric power generator. In embodiments of this invention, the cooling device has a Coefficient of Performance (COP) of greater than 1.0, for example, a COP of about 3 to 4 for a refrigeration system means one unit of power consumed by the cooling device will produce 3 to 4 units of supplemental heat flow supplied to the turbine cycle.

Embodiments of this invention include a heat source configured to heat the working fluid before the turbine, such as in combination with the working fluid heat exchanger. The heat source can be a solar source or a combustion source. The combustion source can be a burner, combustion chamber or power generation device (e.g. internal combustion engine or combustion gas turbine). The power generation device is desirably connected to a second power generator. The exhaust from the combustion source can be fed to the working fluid heat exchanger. Condensate from the humidifying regenerator and/or the cooling device can be used to cool the combustion source. A heating medium heat exchanger can also be connected with the working fluid heat exchanger and configured to heat a heating medium that is independent of the working fluid.

The invention further includes a CCHP system including a compressor, a power generator connected to a turbine; and a closed loop working fluid between the compressor and the turbine. A humidifying regenerator is disposed between the compressor and the turbine, and in combination with the working fluid upstream and again downstream of the turbine. A working fluid heat exchanger is in combination with the working fluid between the turbine inlet and the humidifying regenerator. A heat source is in combination with the working fluid heat exchanger. A heating medium heat exchanger is connected with the working fluid heat exchanger and configured to heat a heating medium that is independent of the working fluid. A first portion of heat energy of the heat source is applied to the working fluid and a second portion of the heat energy of the heat source is applied to the heating medium. A cooling device is in combination with the working fluid between the humidifying regenerator and the compressor inlet. The cooling device cools the working fluid before entering the compressor, and the cooling device also cools a return cooling medium flow that is independent of the working fluid. The heat source can include a solar or combustion source, where the exhaust from the combustion source is fed to the working fluid heat exchanger.

BRIEF DESCRIPTION OF THE DRAWINGS

Objects and features of this invention will be better understood from the following description taken in conjunction with the drawings, wherein.

DETAILED DESCRIPTION

Figure 1:
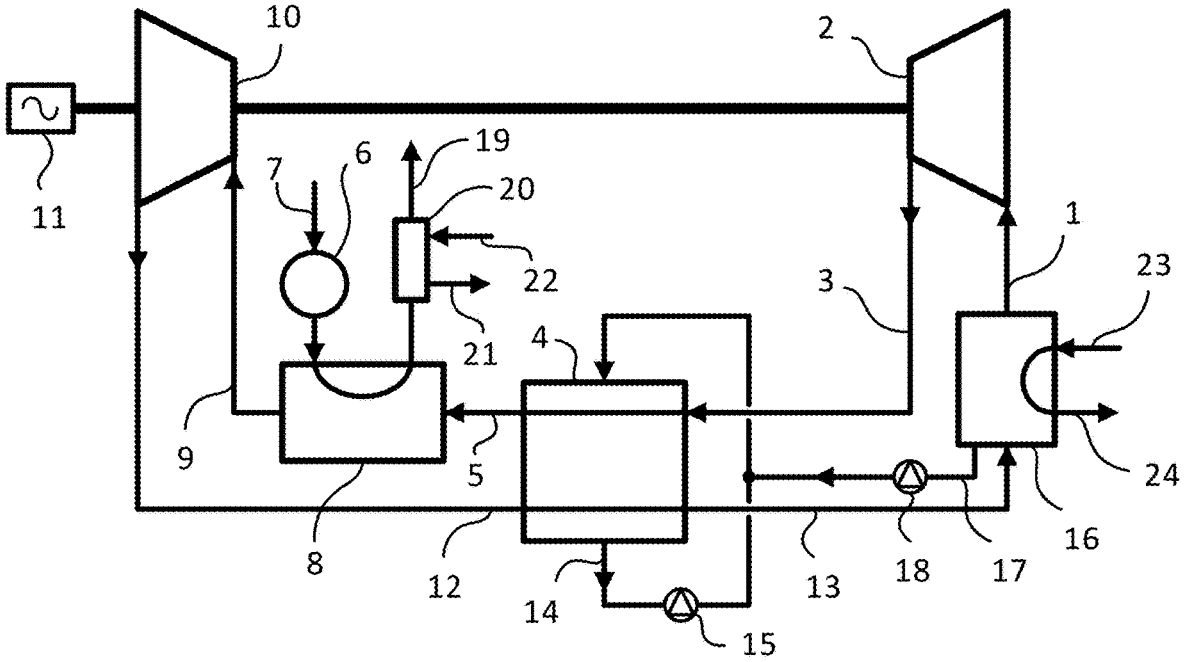
FIG. 1 is a process flow diagram of a CCHP according to one preferred embodiment.

The invention includes or provides a Combined Cooling, Heating, and Power (CCHP) system for electric power generation, space heating and space cooling, such as from a single fuel or solar source, which can be utilized in a variety of industrial facilities, commercial, institutional, and multi-family buildings. The CCHP system of embodiments of this invention is based on a heat engine which operates in modified closed Brayton cycle. The main components of an exemplary system include a low temperature turbine and compressor operating above, at or below atmospheric pressure, a heat exchanger, a humidifying regenerator, and a cooling device, such as a Vapor-Compression Refrigeration (VCR) module, powered by the turbine. The closed Brayton cycle recirculates a working fluid (air or any other inert gas). The working fluid (e.g. air) is humidified and heated before the turbine. A heat exchanger is used to heat the air. Humidified air expelled from the turbine is dehumidified, cooled, and reintroduced into the compressor. Dehumidified air expelled from the compressor is either rejected into the atmosphere or humidified and reintroduced into the turbine.

The CCHP system provides flexibility in the heat source (solar or various fuels), potential modularity and scale-up of the system, and ultra-high efficiency of the turbine cycle at low pressure and low temperature break existing scientific paradigms. Using solar energy or even low temperature heat source such as exhaust gas from a heat engine or industrial process would allow the CCHP system essentially reducing imported energy, eliminating energy-related emissions, and improving energy efficiency of industrial facilities and commercial buildings. Ultra-high efficiency and ultra-low emissions burners/combustors can be used with fossil fuels to power the CCHP system. The turbine-based CCHP system can potentially be cost competitive with state-of-the-art or emerging technologies due to essentially reduced cost of the turbine operating at low pressure (above-, near-, or sub-atmospheric) and low temperature (100-450° C.), while being ultra-high efficient (up to 90% electric efficiency and above 100% total efficiency).

Ultra-efficient electricity generation together with trigeneration (CCHP) according to this invention provides a transformative technology leap for providing power to end-use customers. For example, combined with increased use of renewables, 70% efficient power generation (an effective doubling of current U.S. average electricity generation efficiency), could lead the U.S. down the path of 80% reductions of energy-related emissions by 2050. Meeting these aggressive goals requires a transformation in the energy produce. The system of embodiments of this invention is focused on ultra-efficient electricity generation technology combining cooling and thermal power in one unit.

The sub-atmospheric turbine-based CCHP system of embodiments of this invention can provide an ultra-high efficiency power generation (up to 90%) at low pressure and low temperature (100-450° C.) thus promising to be a cost competitive technology.

FIG. 1 shows a process flow diagram of a CCHP system according to one preferred embodiment. A working fluid cycles in a closed loop between a compressor 2 and a turbine 10 in combination with a power generator 11. The working fluid can be any suitable fluid, and as described herein is any suitable gas, such as air, carbon dioxide, nitrogen, etc. Cooled dehumidified gas 1 enters the compressor 2 and exits as compressed dehumidified gas 3. The gas 3 travels to a humidifying regenerator 4 and exits as humidified compressed gas 5.

Figure 4:
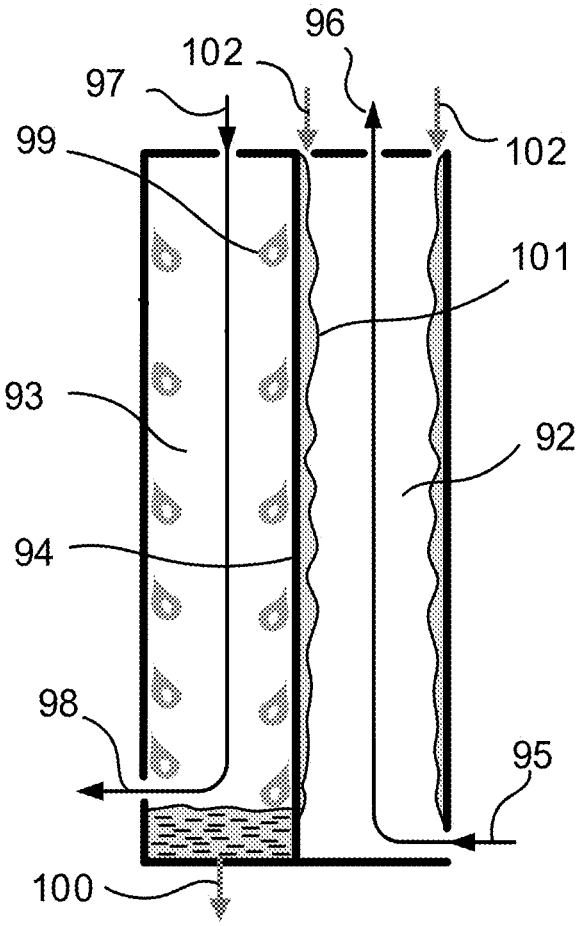
FIG. 4 schematically illustrates a humidifying regenerator according to one embodiment of this invention.

The humidifying regenerator 4 is a heat-mass exchanger. In embodiments of this invention the operating principal is based on a regenerative humidifying-dehumidifying process where a dry working fluid (e.g., air, nitrogen, carbon dioxide, etc.) stream in the heat-mass exchanger is humidified and accompanied by the heat addition for water evaporation while the other humid working fluid stream is dehumidified and accompanied by the heat removal for water vapor condensing. As shown in the exemplary humidifying regenerator of FIG. 4, the dry and humid working fluid streams pass through adjacent channels 92, 93 in the heat-mass exchanger packing with heat transfer through the wall 94 between the channels 92, 93. The water condensate 100 from dehumidifying a humidified working fluid 97 after the turbine 10 into a dehumidified working fluid 98 in dehumidifying channel 93 is collected and the water 102 is pumped to a humidifying channel 92 where it evaporates 101 into the dehumidified working fluid 95 after the compressor 2 to form humidified working fluid 96. The humidifying regenerator thus provides a regenerative mass exchange between dry and humid working fluid streams. The humidifying regenerator module design of embodiments of this invention has multilayer parallel plastic plates that create a working fluid counter flow between the working fluid streams in evaporating and condensing channels.

A working fluid heat exchanger 8 is between the turbine 10 and the humidifying regenerator 4. A heat source 6 heats a heat carrier 7 upstream of the heat exchanger 8. Heated humidified compressed gas 9 is then introduced to the turbine 10 for power generation. A heating medium heat exchanger 20 receives the heat carrier 7 downstream of the working fluid heat exchanger 8. Within the heating medium heat exchanger 20 a return medium 22 (e.g., air, water, or steam, etc.), which is independent of the working fluid is heated into supply medium 22 for heating. A heat carrier exhaust 19 is recycled or otherwise expelled from the heating medium heat exchanger 20.

A cooled humidified gas 12 leaves the turbine 10 and returns to the humidifying regenerator 4, where it leaves a dehumidified gas 13. The water condensate 14 from the humidifying regenerator 4 is reused by the humidifying regenerator 4 to humidify the gas 3. The condensate can be collected and transported by any suitable components, such as including water pump 15.

The dehumidified gas 13 enters a cooling device 16, such as any suitable cooling device for cooling and further dehumidifying the working fluid 12 before entering the compressor 2, and otherwise providing a cooled medium that is independent of the working fluid. The cooling device 16 is desirably powered by the power generator 11, and receives return air 23 for cooling into cooling supply air 24. Water condensate 17 from cooling device 16 can be returned via water pump 19 to the humidifying regenerator 4.

The ultra-high efficiency of the low temperature air turbine is preferably achieved in embodiments of this invention through the (1) air humidification before the turbine and dehumidification after the turbine and (2) air precooling at the compressor inlet. Expansion of the humidified air in the turbine produces more power than the expansion of the same dry air would produce the same pressure drop. This provides higher power to the turbine. Also, compression of the precooled and dehumidified air in the compressor requires significantly less power. These two aspects enable the turbine to achieve ultra-high efficiency even at a low temperature (100-450° C.) at the turbine inlet. It should be noted a VCR system in the turbine cycle consumes power, but the benefit from its utilization supersedes the penalty on power due to the high efficiency of the VCR system with a Coefficient of Performance (COP)>1. This approach to efficiency improvement of the turbine cycle is unique compared to conventional gas turbines principles where the power difference between turbine and compressor is achieved primarily by the turbine inlet temperature increase. The heat and cold produced in the turbine cycle of the CCHP system can either be used for power generation only or for trigeneration of power, useful heat, and space cooling. The CCHP system is flexible to generate cooling, heating and power in various proportions, e.g. heat and power with no cooling, cooling and power with no heat, or X1% cooling-X2% heating-X3% electric power while the total system efficiency can potentially be >100% due to a high performance of the VCR module operating in the heat pump mode with COP>1. The turbine can adjust its power output as demands for electricity, thermal power or cooling fluctuate through the day. At the same time, electric power, cooling and heating proportions can be adjusted in the CCHP unit during its operation. All these innovative features of the proposed CCHP system represent potentially transformational advancement compared to existing or emerging technologies.

One example of a preferred CCHP system would include a turbine-based Advanced Modular Hybrid Heat Engine (MHHE) for Fossil Energy (FE) applications to produce electric or mechanical power from various fuels such as coal derived syngas, hydrogen, or natural gas. The hybrid heat engine can be implemented as a modular unit that can be used with modular coal or biomass gasifiers, with distributed power generation systems, with large power plants comprised of multiple generating units, and with natural gas compression stations. The modular hybrid heat engine can provide cleaner, more efficient, and lower cost generation with better load following capabilities than existing competing technologies with a singular generating source such as solar farm, gas turbine, or combustion engine.

Figure 2:
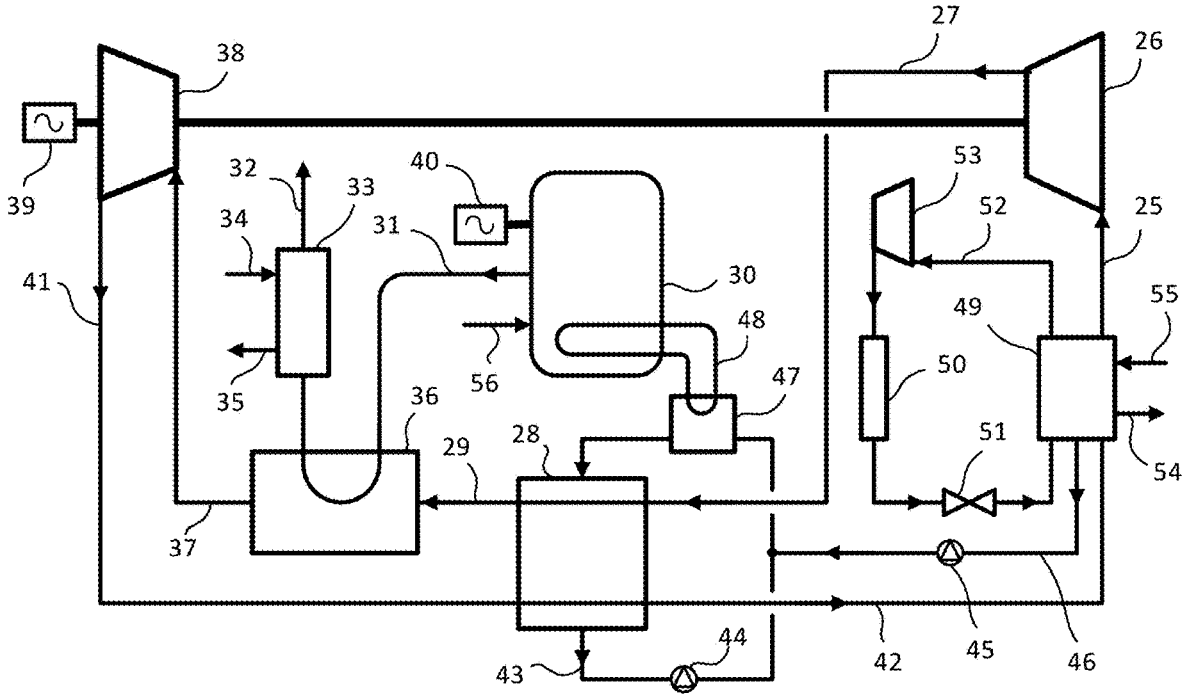
FIG. 2 is a process flow diagram of a CCHP according to one preferred embodiment.

FIG. 2 illustrates a combination of the modified closed Brayton cycle turbine and an internal or external combustion engine to provide combined cooling, heating, and power. In FIG. 2, the cooled dehumidified gas 25 is converted in the compressor 26 to a compressed dehumidified gas 27 that travels to the humidifying regenerator 28 to provide a humidified compressed gas 29. An internal combustion engine 30, running on fuel 56, provides internal combustion engine exhaust gas 31 through a working fluid heat exchanger 36, through a heating medium heat exchanger 33, and then exhausted as cooled flue gas 32. The heat exchanger 33 heats a return medium 34 into a heating supply medium 35. Heat exchanger 36 provides a heated humidified compressed gas 37 to the turbine 38. Both the turbine 38 and the engine 30 have a corresponding power generator 39, 40, respectively.

Cooled humidified gas 41 enters the dehumidifying portion of the humidifying regenerator 28 to provide dehumidified gas 42. Water condensate 43 travels via pump 44 to a water condensate heat exchanger 47 that is part of an internal combustion engine effluent cooling system 48.

Dehumidified gas 42 is cooled and further dehumidified by an evaporator 49 of a cooling device (VCR in this embodiment). The evaporator further provides cooled supply air 54 from return air 55. A refrigerant 52 extends to cooling device compressor 52, then to condenser 50, expansion valve 51 and back to the evaporator 49. Water pump 45 can transfer condensate from the evaporator 49 to the humidifying regenerator 28.

Figure 3:
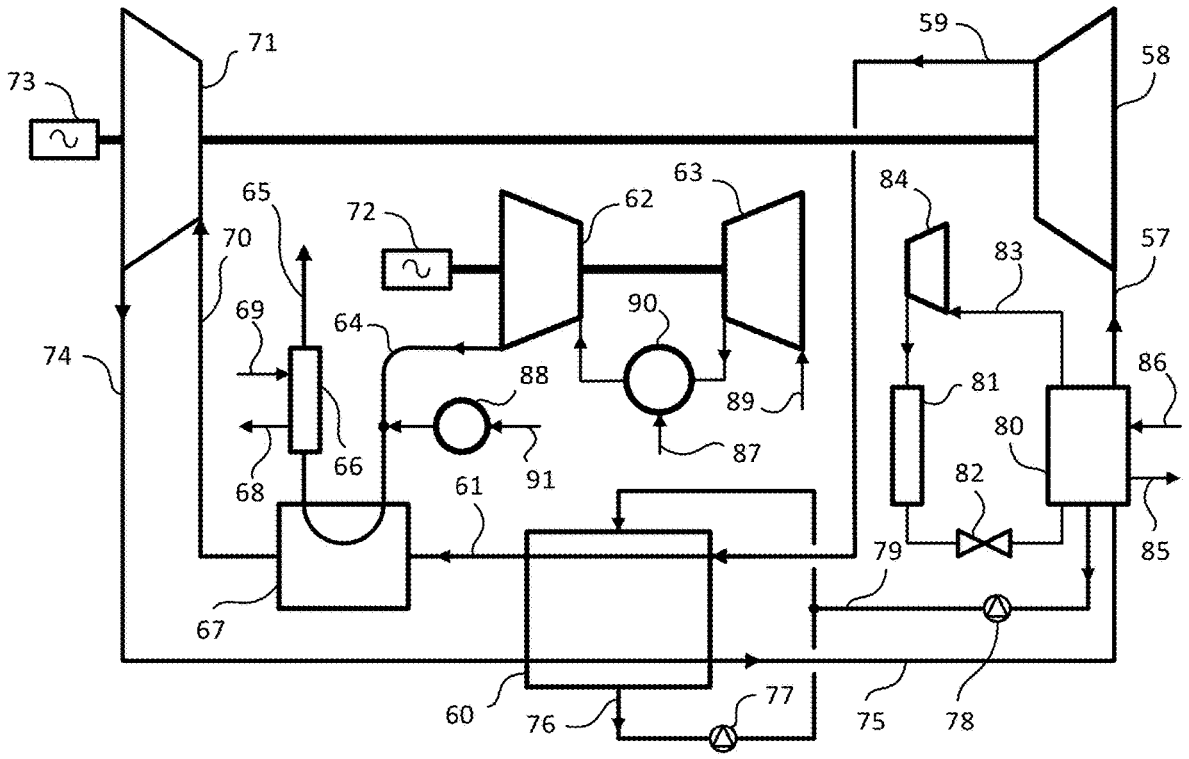
FIG. 3 is a process flow diagram of a CCHP according to one preferred embodiment.

FIG. 3 shows a combination of the modified closed Brayton cycle turbine and combustion gas turbine to provide combined cooling, heating, and power according to embodiments of this invention. In FIG. 3, the cooled dehumidified gas 57 is converted in the compressor 58 to a compressed dehumidified gas 59 that travels to the humidifying regenerator 60 to provide a humidified compressed gas 61.

A combustion gas turbine 62, with combustion gas turbine power generator 72, is paired with a compressor 63 for the combustion gas turbine. The compressor 63 intakes ambient air 89, and an air/fuel mixture 87 is fed to burner 90. The combustion gas turbine exhaust 64 is fed to working fluid heat exchanger 67 through a heating medium heat exchanger 66, and then exhausted as cooled flue gas 65. The exhaust 64 can be further heated or otherwise supplemented by combustion chamber 88 receiving air/fuel mixture 91. The heat exchanger 66 heats a return medium 69 into a heating supply medium 68. Heat exchanger 67 provides a heated humidified compressed gas 70 to the turbine 71, with power generator 73.

Cooled humidified gas 74 enters the dehumidifying portion of the humidifying regenerator 60 to provide dehumidified gas 75. Water condensate 76 travels via pump 77 to a humidifying portion of the humidifying regenerator 60.

Dehumidified gas 75 is cooled and further dehumidified by an evaporator 80 of a cooling device (VCR in this embodiment). The evaporator 80 further provides cooled supply air 85 from return air 86. A refrigerant 83 extends to cooling device compressor 84, then to condenser 81, expansion valve 82, and back to the evaporator 80. Water pump 78 can transfer condensate 79 from the evaporator 80 to the humidifying regenerator 60.

Embodiments of this invention combine fossil fuel energy conversion in a low temperature air turbine with a Reciprocating Internal Combustion Engine (RICE) to create a modular hybrid heat engine. This hybrid heat engine can achieve >65% net electrical or mechanical power conversion efficiency based on Lower Heating Value (LHV) of the fuel and provide ultra-low pollutant emissions at a competitive cost. The RICE can use various fuels such as coal derived syngas, hydrogen, or natural gas to produces power. The air turbine converts the engine exhaust and coolant heat to additional power and multiplies a portion of the engine power that is used to cool the turbine exhaust. The high efficiency of the hybrid heat engine can allow the operating cost of coal power plants to be reduced. The largest operating cost benefit would likely be realized for natural gas power systems. The ultra-low RICE pollutant emissions are able to meet the strictest state regulations such as the California Air Resources Board (CARB) 2007 rules. The total net power output of the MHHE is in the range of 500 kW-60 MW. This covers the range for commercial and industrial applications including distributed power generation and power plants. The modular design of the hybrid heat engine enhances flexibility and reliability of power plants, results in lower labor and overhead costs for engineering, and extends the range in load turndown. This makes the hybrid heat engine ideally suited to distributed energy applications. Larger power plants can be served by deploying multiple hybrid heat engine units.

The main components of exemplary hybrid heat engine are the low temperature turbine engine operating in modified closed Brayton cycle and RICE. The components of the low temperature turbine engine are an air turbine and compressor operating at below above-, near-, or sub-atmospheric pressure, a heat exchanger, a humidifying regenerator, and a cooling device powered by the RICE. The modified closed Brayton cycle recirculates the working fluid (air). Humidified air expelled from the turbine is dehumidified, cooled, and reintroduced into the compressor. Dehumidified air expelled from the compressor is either rejected into the atmosphere or humidified and reintroduced into the turbine. The turbine cycle uses a heat exchanger to heat the air instead of an internal combustion chamber. A unique feature of the system is the humidifying regenerator increases the mass of the working fluid before the turbine and reduces the mass of this working fluid before the compressor. This boosts the turbine cycle efficiency to an ultra-high level.

The ultra-high efficiency of the low temperature air turbine can be achieved by incorporating: (1) air humidification before the turbine and dehumidification after the turbine, (2) air precooling at the compressor inlet, and (3) a high heat recovery rate from RICE. Expansion of the humidified air in the turbine produces more power than the expansion of the same dry air would produce the same pressure drop. This provides higher power to the turbine. Also, compression of the precooled and dehumidified air in the compressor requires significantly less power. These two aspects enable the turbine to achieve ultra-high efficiency even at a low temperature (100-450° C.) at the turbine inlet. It should be noted the cooling device in the turbine cycle consumes power, but the benefit from its utilization supersedes the penalty on power due to the high efficiency of the cooling system with a Coefficient of Performance (COP) >1. This approach to efficiency improvement of the turbine cycle is unique compared to conventional gas turbines principles where the power difference between turbine and compressor is achieved primarily by the turbine inlet temperature increase. Another characteristic of the air turbine is a high heat recuperation rate from the RICE resulting from the high engine exhaust gas temperature (~750° C.) and low air temperature. Most of the exhaust gas heat and the heat from the RICE coolant are recovered and used in the air turbine.

The uniqueness of the turbine-based hybrid heat engine of embodiments of this invention includes the operating conditions of the air turbine which operates at sub-atmospheric pressure and low temperature (100-450° C.) and produces power at high efficiency (up to 90%%). This is possible through the combination of the hybrid heat engine components such as the sub-atmospheric low temperature air turbine, RICE, humidifying regenerator, and cooling device powered by the RICE. The air turbine operates according to a modified closed Brayton cycle with high and low temperature heat exchangers to heat and cool the working fluid (air) before and after the turbine. The air before the turbine is humidified and heated in a humidifying regenerator by the turbine exhaust and then heated in a heat exchanger by the RICE exhaust and cooling circuit. The air temperature at the turbine inlet is 100-450° C. which is much lower compared to high pressure power turbines operated in a simple Brayton cycle. The air, after the turbine, is dehumidified and cooled in a humidifying regenerator and then cooled to about 0° C. or below freezing by the vapor-compressor cooling system powered by the RICE. A low temperature boiling media is used in the cooling device. The compressor in the modified Brayton cycle turbine loop develops a vacuum pressure of about 0.2 bara at the turbine outlet and expands the air to atmospheric pressure. The air from the compressor is either rejected to atmosphere or recirculated in the turbine loop.

Figure 5:
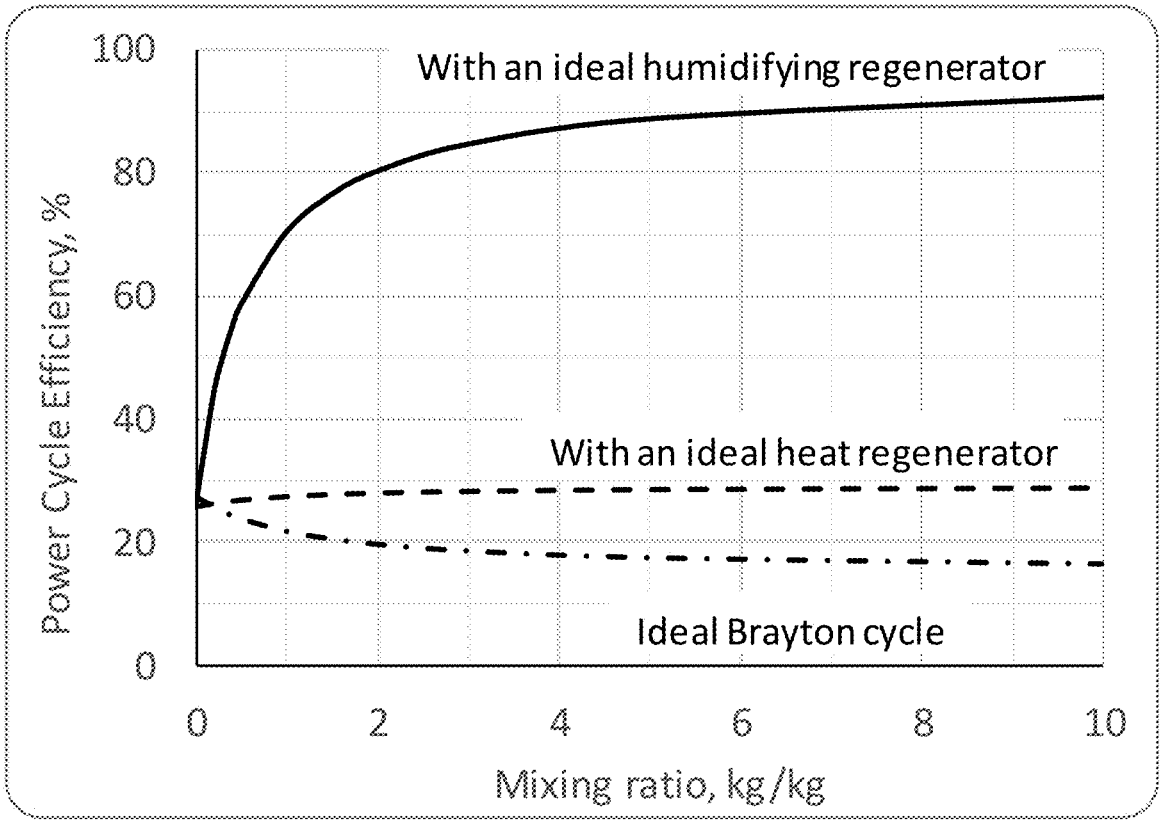
FIG. 5 summarizes an example of calculated CCHP power cycle efficiency (heat input to power generated) versus mixing ratio in comparison with ideal closed Brayton cycle and the Brayton cycle with an ideal heat regenerator.

FIG. 5 presents an example of calculated CCHP system power cycle efficiency (heat input to power generated) versus mixing ratio in comparison with ideal closed Brayton cycle and the Brayton cycle with an ideal heat regenerator. Mixing ratio is the amount of water vapor that is in the air. The calculations were conducted at the following conditions: turbine inlet temperature—265° C., turbine inlet pressure—3 bara, compressor inlet temperature—21° C., compressor inlet pressure—1 bar, and dry air mass flow rate—1 kg/s. As one can see from the figure, the modified closed Brayton cycle with humidifying regenerator is much more efficient compared to the simple Brayton cycle as well the Brayton cycle with heat regenerator. The modified closed Brayton cycle efficiency essentially depends on the mixing ratio. The higher the air humidification rate, the higher the CCHP system power generation (electric) efficiency which can be as high as 90%.

Figures 6, 7:
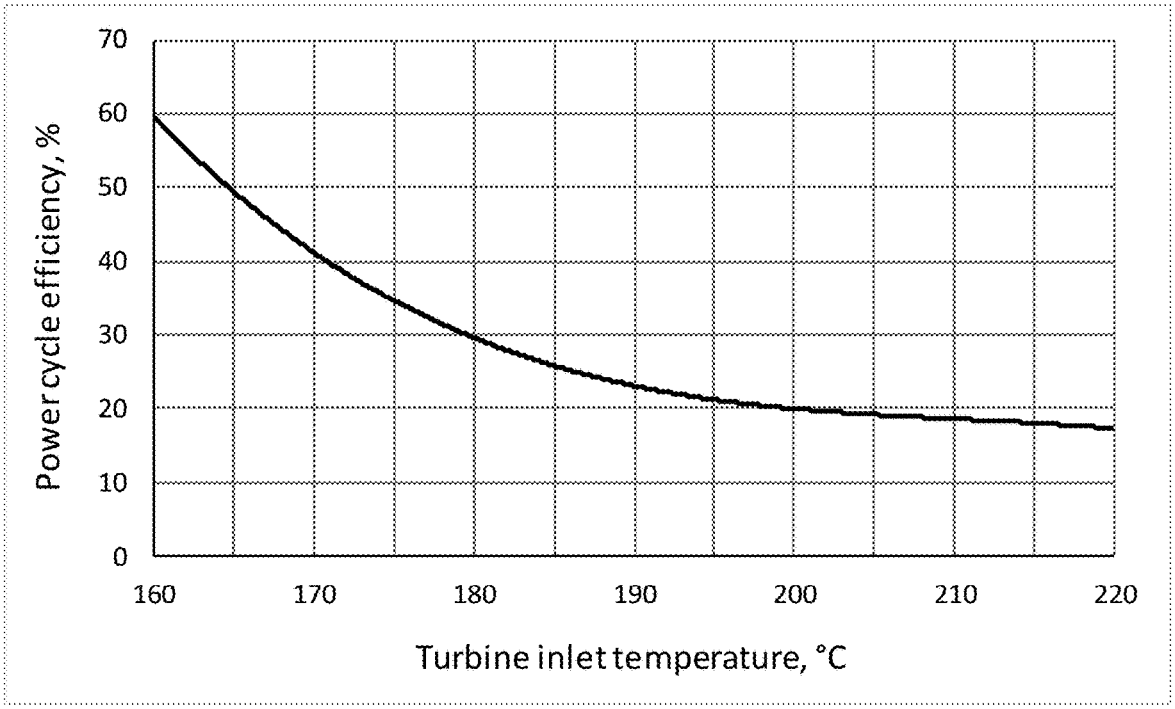
FIG. 6 summarizes an example of calculated CCHP power cycle efficiency (heat input to power generated) versus turbine inlet temperature.
FIG. 7 is a table showing process parameters of the CCHP power cycle according to one preferred embodiment for three different turbine pressures (above-, near-, and sub-atmospheric.

FIG. 6 presents an example of calculated CCHP power cycle efficiency (heat input to power generated) versus turbine inlet temperature. As one can see from the figure, the turbine power cycle efficiency is increased with lower turbine inlet temperature, which is an unexpected result (combustion gas turbine and steam turbine increase their efficiencies with higher temperature).

FIG. 7 presents a table showing process parameters of the CCHP power cycle according to one preferred embodiment for three different turbine pressures (above-, near-, and sub-atmospheric. As one can see from the table, the CCHP system can provide higher power generation efficiency not only at lower turbine inlet temperature but at lower turbine inlet pressure as well, which is an unexpected result (combustion gas turbine and steam turbine increase their efficiencies with higher pressure).

For years in energy research, there has been a focus on the development of electrical or mechanical power heat engine concepts with higher energy efficiency and lower environmental impact for all energy sources. For coal there are two strategies. One has the objective of increasing the efficiency in conventional steam power generation by means of increased temperature and pressure in the steam turbine process. The other involves further development of the known combined processes for generating power from coal. Among the combined processes, gas and steam turbine processes with integrated coal gasification (IGCC) have won the most recognition. Modern steam power plants have efficiencies around 45%, IGCC efficiencies are in the range 38-47% (LHV). Modern turbines have firing temperature of 1430° C. and efficiencies of around 40% (LHV) in simple cycle operation and around 60% in combined cycle operation. The high efficiency is explained by the high firing temperatures. As a result, the turbine requires appropriate cooling of the turbine blades and becomes more expensive. Another trend in the modern power generating industry is "modularity," in which the power generating equipment is prefabricated in a factory environment and packaged to shorten the timeframe needed to plan, engineer, and construct a power plant. This approach offers simplified maintenance features and quality benefits, as components are manufactured in a controlled environment and factory tested.

Small-scale modular coal gasification together with modular power generation systems may open new market opportunities for domestic coal in economically depressed regions and in strategic or targeted high-value applications. At the same time, the advanced modular power generation systems can be used for distributed power generation, large power plants comprised of multiple generating units, or power supply for natural gas compression stations. Current commercial and emerging technologies of modular power generation are based on using gas turbines operated in combine cycle mode, aero-derivative gas turbines, steam turbines, or with RICE. State-of-the-art modular gas turbine generators range in size from 1 to 120 MW. Combustion engine generators are ideally suited to modular use in size from 4 to 30 MW, while some engine manufacturing companies offer a wider range, for example, engine generators come in sizes from as small as 300 kW to more than 100 MW. The equipment cost for gas engine generators is in the range of 925-1900 $/kW for 100 kW-9.3 MW power, while the lowest cost is for the steam turbine generator in the range of 392-668 $/kW for 500 kW-15.0 MW power.

The turbine-based MHHE of embodiments of this invention can significantly advance the state-of-the-art in power generation for FE applications. The overall efficiency of the hybrid heat engines is expected to be comparable to the most efficient combined gas-steam power plants. However, the cost of the hybrid heat engine is expected to be significantly lower due to simplicity of the turbine operating with air at low temperature and pressure. Features such as low temperature and a sub-atmospheric turbine will ensure the provision of high efficiency (65+% based on lower heating value of the fuel) at the competitive manufacturing cost of equipment, namely, $1400-$660/kW at 500 kW-60 MW power output for single-piece production.

Equipment cost can potentially be reduced to below $500/kW with large-scale production. The extremely low capital and operational cost will revolutionize the power generation technologies by providing a solution and this overcomes major constraints for the advancement of the technology. A stoichiometric RICE with advanced exhaust gas treatment will provide ultra-low pollutant emissions to meet the CARB2007 requirements (e.g. NOx<0.07 lb/MW-h). The RICE will be capable of operating on a variable quality gas from pipeline natural gas to biogas, including syngas and hydrogen from coal gasifier.

The invention further includes a turbine-based MHHE to produce electricity or mechanical power from various fuels such as simulated coal derived syngas, hydrogen, or natural gas. The hybrid heat engine can be implemented as a modular unit composed of an advanced sub-atmospheric low temperature air turbine and the RICE. The sub-atmospheric air turbine includes a low temperature turbine operating in modified closed Brayton cycle, compressor, high temperature heat exchanger, low temperature cooler, and humidifying regenerator. The low temperature turbine can use low cost material and be less expensive than conventional high efficiency turbines.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

Moreover, those skilled in the art and guided by the teachings herein identified, described or discussed will understand and appreciate that the subject development encompasses a variety of features and is thus capable of manifestation in a variety of specific forms or embodiments and is thus not to be construed as limited to the specific forms or embodiments herein identified or described.

What is claimed is:

1. A combined cooling, heating, and power system, comprising:

a working fluid cycling between a compressor and a turbine in combination with a power generator, wherein the working fluid comprises a closed loop in a turbine-compressor cycle operating at least in part at or below atmospheric pressure and/or at a temperature of 100-450° C.;

a humidifying regenerator disposed between the compressor and the turbine, and in combination with the working fluid upstream and again downstream of the turbine;

a working fluid heat exchanger in combination with the working fluid between the turbine and the humidifying regenerator; and a cooling device in combination with the working fluid between the humidifying regenerator and the compressor, wherein the cooling device cools the working fluid before entering the compressor.

2. The system of claim 1, wherein the cooling device cools a return medium flow that is independent of the working fluid.

3. The system of claim 1, wherein the cooling device is powered by the power generator.

4. The system of claim 1, wherein condensate from the humidifying regenerator and the cooling device is used by the humidifying regenerator to humidify the working fluid.

5. The system of claim 1, wherein the humidifying regenerator is configured to humidify the working fluid after the compressor and to dehumidify the working fluid after the turbine.

6. The system of claim 5, wherein the humidifying regenerator increases a mass of the working fluid before the turbine and reduces the mass of the working fluid after the turbine and before entry into the compressor.

7. The system of claim 5, wherein the dehumidified working fluid is introduced to the cooling device.

8. The system of claim 7, wherein the humidified heated working fluid is introduced to the turbine.

9. The system of claim 7, wherein the cooled, dehumidified working fluid is introduced to the compressor.

10. The system of claim 1, further comprising a heat source in combination with the working fluid heat exchanger.

11. The system of claim 10, further comprising a heating medium heat exchanger connected with the working fluid heat exchanger and configured to heat a heating medium that is independent of the working fluid.

12. The system of claim 1, further comprising a heat source connected to the turbine and configured to heat the working fluid before the turbine.

13. The system of claim 12, wherein the heat source comprises a solar source or a combustion source.

14. The system of claim 13, wherein the combustion source is connected to a second power generator.

15. The system of claim 14, wherein the combustion source comprises an internal combustion engine or a combustion gas turbine, and exhaust from the combustion source is fed to the working fluid heat exchanger.

16. The system of claim 15, wherein condensate from the humidifying regenerator and/or the cooling device cools the combustion source.

17. The system of claim 1, wherein the working fluid is below atmospheric pressure at a turbine outlet and the compressor is configured to pressurize the working fluid to atmospheric pressure.

18. A combined cooling, heating, and power system, comprising:

a compressor;

a power generator connected to a turbine;

a working fluid between the compressor and the turbine, wherein the working fluid comprises a closed loop in a turbine-compressor cycle operating at least in part at or below atmospheric pressure and/or at a temperature of 100-450° C.;

a humidifying regenerator disposed between the compressor and the turbine, and in combination with the working fluid upstream and again downstream of the turbine;

a working fluid heat exchanger in combination with the working fluid between the turbine and the humidifying regenerator;

a heat source in combination with the working fluid heat exchanger;

a heating medium heat exchanger connected with the working fluid heat exchanger and configured to heat a heating medium that is independent of the working fluid, wherein a first portion of heat energy of the heat source is applied to the working fluid and a second portion of the heat energy of the heat source is applied to the heating medium; and a cooling device in combination with the working fluid between the humidifying regenerator and the compressor, wherein the cooling device cools the working fluid before entering the compressor, and the cooling device cools a return medium flow that is independent of the working fluid.

19. The system of claim 18, wherein the heat source comprises a solar source or a combustion source connected to a second power generator.

20. The system of claim 18, wherein the heat source comprises a combustion source connected to a second power generator, and exhaust from the combustion source is fed to the working fluid heat exchanger.

* * * * *